US006460252B1

(12) United States Patent
Nakano

(10) Patent No.: US 6,460,252 B1
(45) Date of Patent: Oct. 8, 2002

(54) ROTARY ELECTRIC SHAVER

(75) Inventor: Tsuyoshi Nakano, Matsumoto (JP)

(73) Assignee: Izumi Products Company, Nagano (JP)

( * ) Notice: Subject to any disclaimer, the term of this patent is extended or adjusted under 35 U.S.C. 154(b) by 0 days.

(21) Appl. No.: 09/597,449

(22) Filed: Jun. 20, 2000

(30) Foreign Application Priority Data

Jun. 21, 1999 (JP) ..... 11-174677

(51) Int. Cl.[7] ..... B26B 19/14
(52) U.S. Cl. ..... 30/43.4; 30/43.6; 30/346.51
(58) Field of Search ..... 30/43.6, 43.5, 30/43.4, 206, 347, 240, 346.51

(56) References Cited

U.S. PATENT DOCUMENTS 2,536,015 A * 12/1950 Konrad ..... 30/346.51
4,168,570 A * 9/1979 Bakker et al. ..... 30/43.6
4,240,199 A * 12/1980 Boiten et al. ..... 30/346.51
5,283,953 A * 2/1994 Ikuta et al. ..... 30/43.6
5,687,481 A * 11/1997 De Boer et al. ..... 30/43.6
6,145,200 A * 11/2000 Jorna et al. ..... 30/43.6

FOREIGN PATENT DOCUMENTS

EP 0885696 12/1998

* cited by examiner

*Primary Examiner*—Kenneth E. Peterson
*Assistant Examiner*—Omar Flores Sánchez
(74) *Attorney, Agent, or Firm*—Koda & Androlia

(57) ABSTRACT

A rotary shaver comprising outer cutters and inner cutters; and each of the outer cutters comprises an inside outer-cutter member and a cylindrical outside outer-cutter member which concentrically surrounds the inside outer-cutter member, and each of the inner cutters comprises an inside inner-cutter member and an outside inner-cutter member that surrounds the inside inner-cutter member. The inside inner-cutter members make a sliding contact with the inside outer-cutter members, and the outside inner-cutter members make a sliding contact with the outside outer-cutter members. The outside outer-cutter members are free to tilt and free to move with respect to axes of outer cutter holes made in a shaver head. The inside outer-cutter members are free to tilt and free to move with respect to the axes of the outside outer-cutter members. The inside inner-cutter members are rotated with their axes being coincide with the axes of the corresponding inside outer-cutter members; and the outside inner-cutter members are rotated with their axes being coincide with the axes of the corresponding outside outer-cutter members.

12 Claims, 7 Drawing Sheets

ROTARY ELECTRIC SHAVER

BACKGROUND OF THE INVENTION

1. Field of the Invention

The present invention relates to rotary electric shavers.

2. Prior Art

A conventional typical rotary electric shaver is shown in FIGS. 6 and 7.

The electric shaver 10 is comprised of a main body case 16 and a shaver head 24. The main body case 16 is made of a synthetic resin and is held in the hand during shaving. Inside this main body case 16 is installed a motor 12, a power supply switch 14 and a power supply (not shown in the figures) that supplies electric power to the motor 12, etc. The shaver head 24 is detachably mounted to the upper end of the main body case 16, and it contains outer cutters 18, inner cutters 20, inner cutter bases 22 used for the inner cutters 20, etc.

The electric shaver 10 of FIGS. 6 and 7 is provided with three outer cutters 18 installed in the shaver head 24, and the centers of the outer cutters are positioned roughly at the vertices of an equilateral triangle. However, there is no restrictions on the number of outer cutters 18.

Inner cutter drive shafts 28, made of a synthetic resin and used to transmit the rotational force of the motor 12 to the inner cutters 20 of the shaver head 24, are installed in a number equal to the number of the inner cutters 20. The inner cutter drive shafts 28 protrude from a cutter receiving base 26. The cutter receiving base 26 is made of a synthetic resin and is attached so as to cover the opening in the upper portion of the main body case 16. When the shaver head 24 is attached to the main body case 16 (more specifically to the cutter receiving base 26 of the main body case 16), the tip ends of the inner cutter drive shafts 28 are connected by interlocking engagement to the inner cutter bases 22 to which the inner cutters 20 are attached. As a result, the inner cutters 20 receive a rotational force from the inner cutter drive shafts 28 and are rotated as a unit with the inner cutter drive shafts 28.

The structures of the respective components described above will be detailed below.

First, the shaver head 24 comprises: a cutter frame 30 made of a synthetic resin, outer cutters 18 made of metal, outer cutter holder 32 made of a synthetic resin so as to hold the outer cutters 18, inner cutters 20 made of metal, inner cutter bases 22 made of a synthetic resin and to which the inner cutters 20 are attached, and a cutter retaining plate 34 made of a synthetic resin so as to rotatably hold the inner cutters 20.

The outer cutters 18 are made of metal and formed in the shape of inverted cylindrical bodies. The outer cutters 18 thus have a bottom and a low overall height (so as to be in an inverted saucer or cap shape). The upper-surface portion of each outer cutter which comes into contact with the skin has an annular outer hair entry region V and an annular inner hair entry region W. The hair entry region W is concentric to the inside of the outer hair entry region V. A positioning/engaging portion 36 (formed as an engaging recess for example) is formed in the undersurface of the region X which is inside the inner hair entry region W. The positioning/engaging portion 36 prevents wobbling of the rotating shaft of each inner cutter 20 with respect to the corresponding outer cutter 18 by way of making an interlocking engagement with the end of the inner cutter base. (described later) so that the inner cutter 20 consistently rotates concentrically with the outer cutter 18.

A plurality of hair entry openings 40 are formed in the hair entry regions V and W. In FIG. 6, the hair entry openings 40 are slit-form openings that extend from the outer-circumferential sides to the inner-circumferential sides of the respective hair entry regions V and W. The hair entry openings 40, however, may be scattered small round, oval or slot-form openings.

The surfaces of the respective hair entry regions V and W are made flat. In the outer cutters 18 shown in FIG. 7, the respective hair entry regions V and W are formed so that the hair entry regions are positioned on the same plane.

The outer cutters 18 are set in the outer cutter holder 32 that are made of a synthetic resin so that the outer cutters 18 are not rotatable and the amount of protrusion of the outer cutters 18 from the outer cutter holder 32 is changeable. The outer cutters 18 are tiltable in all directions within a specified angular range inside the outer cutter holder 32.

The outer cutters 18 are mounted in the cutter frame 30 together with the outer cutter holder 32 so that the upper end surfaces of the outer cutters 18 protrude from outer cutter holes 42 formed in the cutter frame 30. The internal diameters of the outer cutter holes 42 are slightly larger than the external diameters of the outer cutters 18. Accordingly, the outer cutters 18 are provided in the cutter frame 30 so that the amount of protrusion of the outer cutters 18 from the cutter frame 30 may change when the outer cutters 18 are moved along the axes of the outer cutter holes 42. The outer cutters 18 are tiltable within a specified angular range in all directions with respect to the axes of the outer cutter holes 42.

The metal inner cutters 20 are U-shaped or Y-shaped inner cutter bodies 20*b*, and the tip ends thereof are bifurcated and disposed uprightly at equal angular intervals on the outer edge portion of an annular body 20*a*. Of the respective tip ends formed by the bifurcation of each inner cutter body 20*b*, the tip end on the outer side contacts the inside surface of the outer hair entry region V of the corresponding outer cutter 18, while the tip end on the inner side contacts the inside surface of the inner hair entry region W of the corresponding outer cutter 18. When the inner cutters 20 rotate, the tip ends of the respective inner cutter bodies 20*b* are rotated while making sliding contact with the inside surfaces of the respective hair entry regions V and W of the corresponding outer cutters 18.

The cutter retaining plate 34 holds the inner cutters 20. The retaining plate 34, made of a synthetic resin material, is comprised of attachment rings 34*a*, which are equal in number to the inner cutters 20, and a supporting frame 34*b*, which connects these attachment rings 34*a* into an integral unit. Anchoring portions 48 are disposed on the inner circumferential surfaces of the attachment rings 34*a* so as to protrude toward the axes of the attachment rings 34*a*. An attachment screw 50, which is used to attach the cutter retaining plate 34 to the cutter frame 30 is disposed in the center of the cutter retaining plate 34.

The structure for holding the inner cutters 20 by the cutter retaining plate 34 will be described below.

The inner cutter bases 22 to which the inner cutters 20 are fastened are formed in a columnar shape using a synthetic resin material. An inner cutter 20 is fastened to one end (the upper end in FIG. 7) of each inner cutter base 22; and a flange 52 is formed around the outer circumferential surface of the other end (the lower end in FIG. 7) of each inner cutter base 22. A positioning/engaging portion 38 (formed as an engaging projection, for example) which engages with a positioning/engaging portion 36 formed in the corresponding outer cutter 18 is formed in the center of the first end of each inner cutter base 22. The radius of the flange 52 of each inner cutter base 22 is greater than the distance from axis (center) of the corresponding attachment ring 34*a* to the inside tip end of the anchoring portions 48 formed on the inner circumferential surface of the attachment ring 34*a*. Also, the radius of the portions of the inner cutter base 22 other than the flange 52 is smaller than the distance from the axis of the attachment ring 34*a* to the inside tip end the anchoring portion 48. An engaging recess 56 is formed on the end surface of the other end of each inner cutter base 22 so that an engaging projection 54 formed on the tip end of the corresponding inner cutter drive shaft 28 is inserted in this engaging recess 56.

When each inner cutter 20 is fastened to the corresponding inner cutter base 22, the annular body 20*a* of the inner cutter 20 is first fastened to the first end of the inner cutter base 22 so that the inner cutter 20 is fastened to the inner cutter base 22. As a result, the positioning/engaging portion 38 protrudes from the inside of the annular body 20*a*.

Afterward, the inner cutter base 22 is inserted into the corresponding attachment ring 34*a* of the cutter retaining plate 34 from the other end. In this case, the anchoring portions 48 of the attachment ring 34*a* interferes with the flange 52 of the inner cutter base 22. Thus, the flange 52 is inserted into the attachment ring 34*a* while causing the anchoring portions 48 to bend slightly.

As a result, the inner cutter 20, that has a radius greater than the distance from the axis of the attachment ring 34*a* to the inside tip ends of the anchoring portions 48, and the flange 52 of the inner cutter base 22 are positioned on both sides of the attachment ring 34*a* with the attachment ring 34*a* sandwiched in between. The inner cutter 20 is thus held in the attachment ring 34*a* so that the inner cutter 20 is retained and not to slip out. The inner cutter 20 is held so that it is rotatable inside the attachment ring 34*a,* that it is tiltable in all directions with respect to the axis of the attachment ring 34*a,* and that it is slidable in the direction of the axis.

Next, how the outer cutters 18 and inner cutters 20 are attached to the cutter frame 30 will be described.

First, the outer cutter holder 32 to which the outer cutters 18 are attached is mounted in the cutter frame 30. Afterward, the cutter retaining plate 34 holding the inner cutters 20 is attached to the cutter frame 30 by screwing the attachment screw 50 into an internally threaded screw hole 30*a* formed inside the cutter frame 30. As a result, the outer cutter holder 32 is pressed by the cutter retaining plate 34, and the outer cutters 18 and inner cutters 20 are held to the cutter frame 30 so as not to slip out.

By way of turning the attachment screw 50 in the reverse direction, the inner cutters 20 is removed as a unit with the cutter retaining plate 34, and the outer cutters 18 is removed as a unit with the outer cutter holder 32.

Next, the main body case 16 that includes the inner cutter drive shafts 28 will be described.

The main body case 16 is formed as a cylinder having an open top and a closed bottom. A motor 12, a battery (not shown), a control circuit and other constituting elements are installed inside this main body case 16.

A gear shaft receiving plate 58 is installed inside the main body case 16 near the rim of the opening in the main body case 16. The motor 12 is fastened to the gear shaft receiving plate 58 at right angles with reference to the output shaft 12*a* of the motor 12 protruding. Main supporting shafts 60 are fastened to the gear shaft receiving plate 58 adjacent to the output shaft 12*a* and parallel to the output shaft 12*a* in positions corresponding to the outer cutters 18. A motor gear 62 is attached to the output shaft 12*a* of the motor 12. Inner cutter driving gears 64 made of a synthetic resin are rotatably attached to the main supporting shafts 60 so that these inner cutter driving gears 64 engage with the motor gear 62. At the centers of the upper surfaces of the inner cutter driving gears 64, cylindrical coverings 65 for covering the main supporting shafts 60 that are passed through the inner cutter driving gears 64 are integrally formed so as to be upright with respect to the inner cutter driving gears 64. Furthermore, shaft anchoring projections 70 are formed so as to surround the coverings 65.

A cutter receiving base 26 is mounted in the upper end opening of the main body case 16 so that the receiving base 26 is positioned above the gear shaft receiving plate 58 and close off the upper end opening. Drive shaft holes 66 are formed coaxially with the axes of the respective main supporting shafts 60 in the cutter receiving base 26.

The inner cutter drive shafts 28 are positioned so that the tip ends of these shafts protrude from the drive shaft holes 66. A plurality of engagement projections 68 are formed on the outer circumferential surfaces of the lower ends of the inner cutter drive shafts 28. These engagement projections 68 respectively engage with a plurality of shaft anchoring projections 70 which are formed on the upper surfaces of the inner cutter driving gears 64 so that the engagement projections 68 surround the lower portions of the inner cutter drive shafts 28. More specifically, these components are arranged so that the inner cutter drive shafts 28 (only one drive shaft shown in FIG. 7) are rotatable as a unit with the inner cutter driving gears 64, the inner cutter drive shafts 28 are tiltable in all directions with respect to the axes of the inner cutter driving gears 64 (which are also the axes of the main supporting shafts 60), and the inner cutter drive shafts 28 are movable a specified distance along their axes.

Furthermore, engaging projections 54 are formed on the closed upper ends of the inner cutter drive shafts 28, and the lower ends of the inner cutter drive shafts 28 are formed open. The coverings 65 formed on the inner cutter driving gears 64 are inserted into the interiors of the inner cutter drive shafts 28 from the lower-end openings.

Outside inner cutter member springs (called "outer springs") 72 are installed inside the inner cutter drive shafts 28. The outer springs (coil springs) 72 are fitted over the coverings 65. These outer springs 72 are installed in a compressed state between the inside upper surface of the inner cutter drive shafts 28 and the upper surfaces of the inner cutter driving gears 64. Thus, the outer springs 72 constantly urge the inner cutter drive shafts 28 upward relative to the inner cutter driving gears 64. The inner cutter drive shafts 28 are driven by the outer springs 72 in a direction that causes the inner cutter drive shafts 28 to move away from the inner cutter driving gears 64. However, when the inner cutter drive shafts 28 are separated from the inner cutter driving gears 64 by a specified distance, the engagement projections 68 formed on the outer circumferential surfaces of the lower ends of the inner cutter drive shafts 28 come to engage with the shaft anchoring projections 70 formed on the upper surfaces of the inner cutter driving gears 64. Thus, the inner cutter driving gears 64 are prevented from slipping off of the coverings 65.

With the above-described structures of the shaver head 24 and main body case 16, when the shaver head 24 is attached to the main body case 16, the engaging projections 54 of the inner cutter drive shafts 28 (only one drive shaft 28 shown in FIG. 7) fit into the engaging recesses 56 of the lower ends of the inner cutter bases 22. In addition, the inner cutter drive shafts 28 are pressed by the inner cutter bases 22, and the inner cutter drive shafts 28 are pushed slightly into the interior of the cutter receiving base 26 against the driving force of the outer springs 72.

In this state, the driving force of the outer springs 72 is transmitted to the inner cutters 20 from the inner cutter drive shafts 28 via the inner cutter bases 22, so that the inner cutters 20 are pushed toward the outer cutters 18. As a result, the tip ends of the inner cutter bodies 20*b* of the inner cutters 20 make a close contact with the inside circumferential surfaces of the outer cutters 18. Also, the outer cutters 18 are pushed by the inner cutters 20 so that the outer cutters 18 are in a state of maximum protrusion from the cutter frame 30.

When hairs are shaved using the electric shaver 10 as described above, the main body case 16 is held in the hand, and the outer cutters 18 protruding from the surface of the cutter frame 30 are pressed against the skin. In this case, in conformity with the shape of the skin, the outer cutters 18 are moved toward the interior of the cutter frame 30 against the driving force of the outer springs 72 and the elastic force of the retaining plate 34 (i.e., the amount of protrusion from the cutter frame 30 varies). The outer cutters 18 also tilt in conformity with the shape of the skin. Thus, the respective hair entry regions V and W formed in the outer cutters 18 snugly fit against the skin. Even when the outer cutters 18 tilt with respect to the cutter frame 30, the positioning/engaging portions 38 formed on the ends of the inner cutter bases 22 are engaged in an interlocking manner with the positioning/engaging portions 36 formed in the outer cutters 18. Accordingly, the inner cutters 20 also tilt in accordance with the inclination of the outer cutters 18, so that the respective tip ends of the inner cutter bodies 20*b* of the inner cutters 20 are maintained in a close contact with the inside surfaces of the respective hair entry regions V and W of the outer cutters 18.

Generally speaking, the shape of the human face, e.g., in the cheeks, jaw and throat where hairs grow, is rich in variation. In some cases, the close contact with the skin (as viewed from the standpoint of the outer cutters 18 overall) may be more improved if the inner hair entry regions W protrude further from the surface of the cutter frame 30 than the outer hair entry regions V; or conversely, if the inner hair entry regions W are sunk further inward than the outer hair entry regions V, the conditions of shaving are improved. Furthermore, an overall close contact of the outer cutters 18 with the skin is sometimes better if the inner hair entry regions W are tilted with respect to the outer hair entry regions V.

However, in the conventional rotary electric shaver described above, each of the outer cutters 18 is a single cylindrical body, and each of the inner cutters 20 also has a similar integral structure. As a result, the positional relationship of the outer hair entry regions V and inner hair entry regions W is fixed; and the shape of the contact surfaces of the outer cutters 18 that contact the skin cannot vary in accordance with the shape of the skin (i.e., the inner hair entry regions W cannot protrude and retract, or tilt with respect to the outer hair entry regions V). Thus, the better shaving conditions described above cannot necessarily be realized.

SUMMARY OF THE INVENTION

Accordingly, the present invention is to solve the above-described problems with prior art shavers.

The object of the present invention is to provide a rotary electric shaver in which the shape of the contact surfaces of the outer cutters that contact the skin during shaving can vary in accordance with changes in the shape of the skin contacted by the outer cutters.

The above-described object is accomplished by a unique structure of the present invention that has the structure described below:

The rotary electric shaver of the present invention is characterized in that the shaver comprises:

an inside outer-cutter member, a cylindrical outside outer-cutter member which concentrically surrounds the inside outer-cutter member and is mounted in a cutter frame so that the end surfaces of the outside and inside outer-cutter members protrude from an outer cutter hole formed in the cutter frame, an inside inner-cutter member which makes sliding contact with the inside outer-cutter member, and an outside inner-cutter member which makes sliding contact with the outside outer-cutter member, and wherein the outside outer-cutter member is provided in the cutter frame so that the outside outer-cutter member tiltable with respect to the axis of the outer cutter hole and is movable along the axis, and the inside outer-cutter member is connected to the outside outer-cutter member so that the inside outer-cutter member is tiltable with respect to the axis of the outside outer-cutter member and is movable along the axis, the inside inner-cutter member is engaged with the inside outer-cutter member so that the inside inner-cutter member is rotatable with the axes of the inside inner-cutter member and inside outer-cutter member being coincide with each other, and the outside inner-cutter member is engaged with the outside outer-cutter member so that the outside inner-cutter member is rotatable with the axes of the outside inner-cutter member and outside outer-cutter member being coincide with each other.

As a result, if the shape of the skin contacted by the outer cutters (each comprising the inside outer-cutter member and the cylindrical outside outer-cutter member) varies, the outside outer-cutter members and inside outer-cutter members are moved independently in conformity with the shape of the skin. Thus, the respective contact surfaces of these outer cutters make a snug contact more easily with the skin, and improved shaving is performed.

DETAILED DESCRIPTION OF THE PREFERRED EMBODIMENTS

Figure 1:
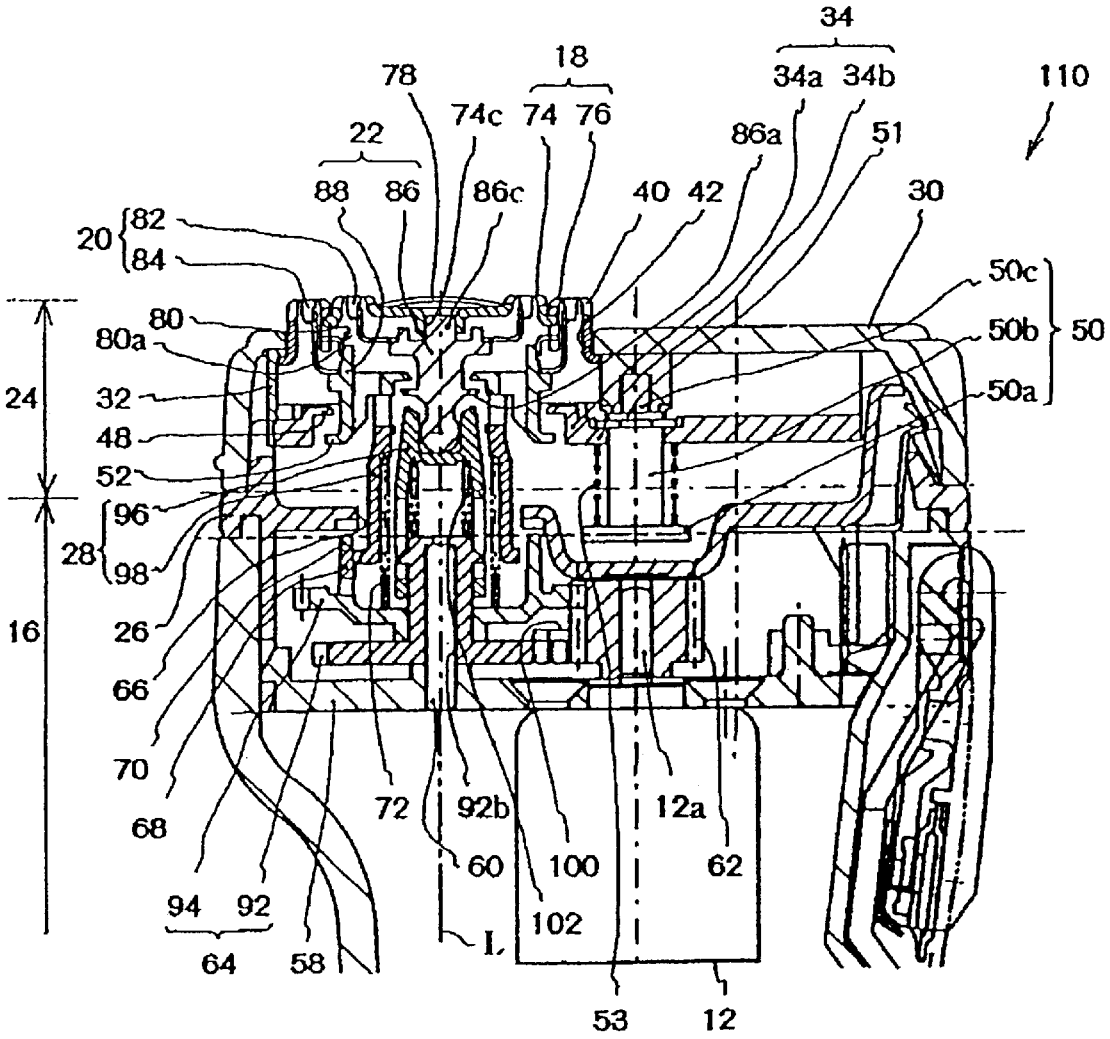
FIG. 1 is a cross-sectional view of essential portion of the internal structure of the shaver head of the electric shaver of the present invention.

Below, the preferred embodiments of the present invention will be described in detail with reference to the accompanying drawings. The constituting elements which are the same as those of the shaver 10 of the prior art described above will be labeled with the same reference numerals, and a detailed description thereof will be omitted.

Figure 6:
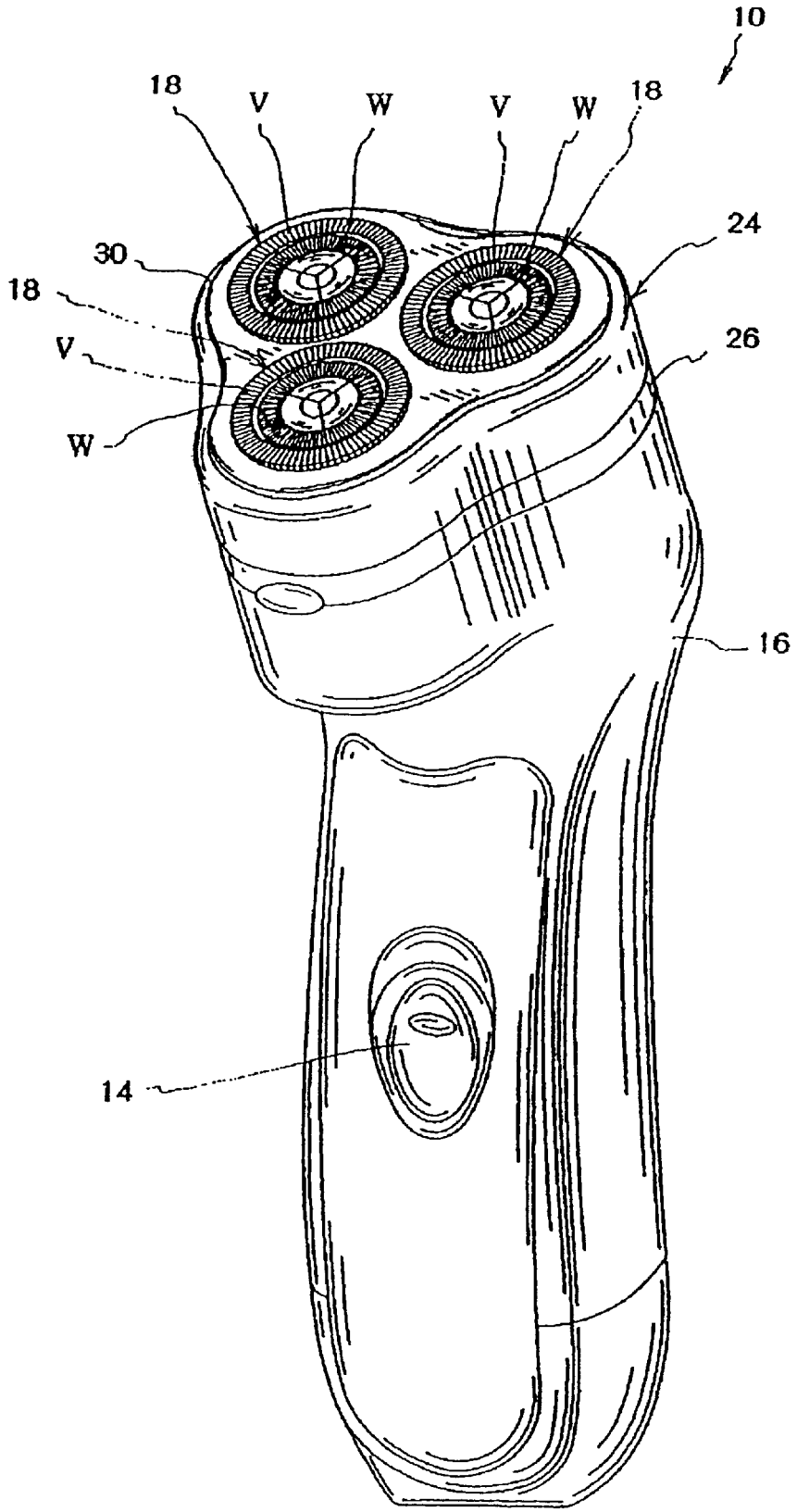
FIG. 6 PRIOR ART
FIG. 6 is a perspective view of the external appearance of an electric shaver of prior art.
Figure 7:
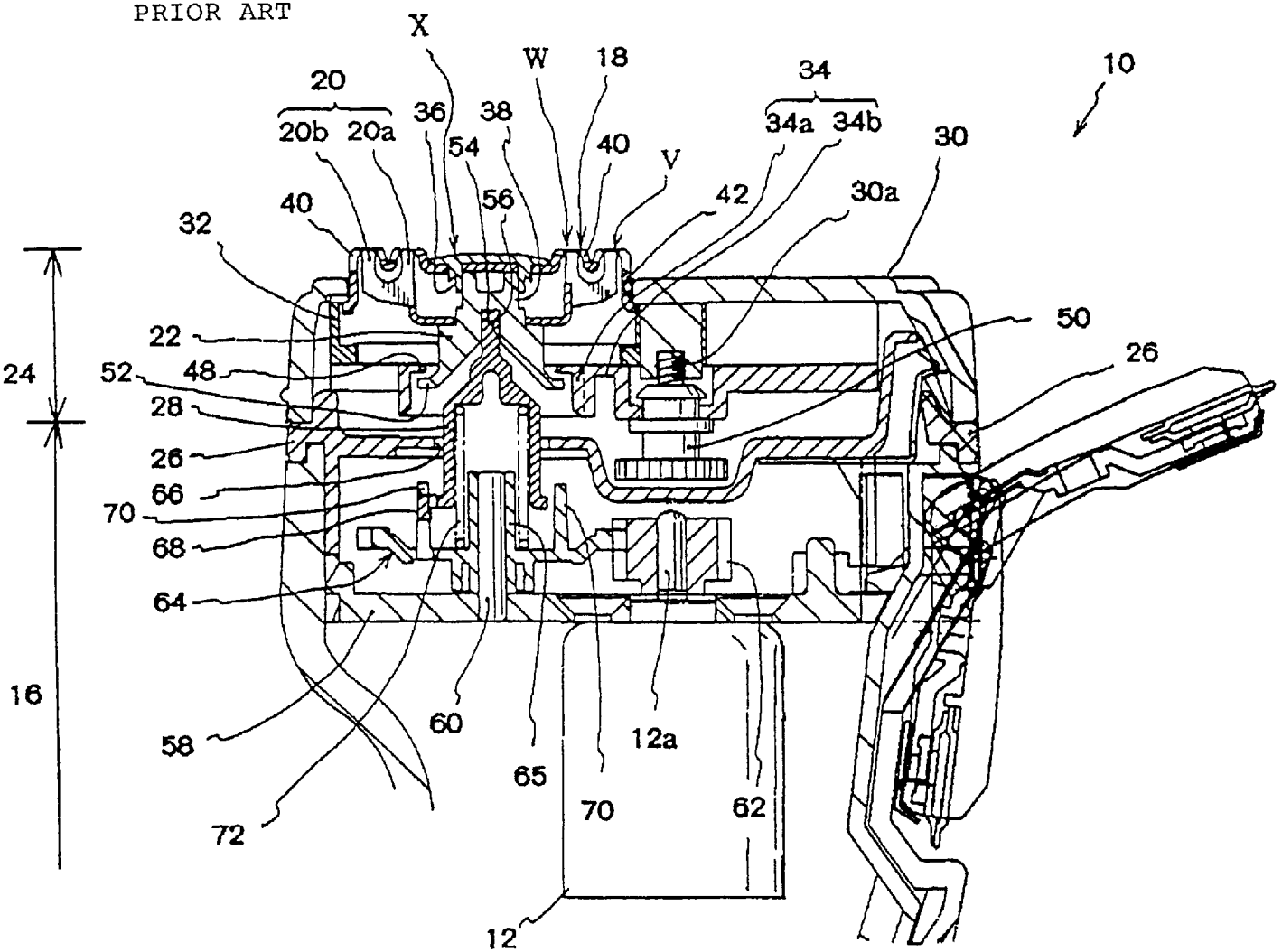
FIG. 7 PRIOR ART
FIG. 7 is a cross sectional view of the essential portion of the internal structure of the shaver head of a conventional electric shaver.

The overall external appearance of the rotary electric shaver 110 of the present invention is substantially the same as that of the conventional rotary electric shaver 10 shown in FIG. 6. However, the internal structure differs. Accordingly, the structure of the rotary electric shaver of the present invention will be described with reference to FIG. 1, which shows the characteristic structure of the present embodiment, and FIG. 6, which shows the conventional shaver.

The rotary electric shaver 110 comprises a main body case 16 and a shaver head 24. The shaver head 24 is detachably attached to the upper portion of the main body case 16, and it contains outer cutters 18 and inner cutters 20, along with other components. In the shown embodiment, as seen from FIG. 6, the rotary electric shaver 110 has three outer cutters 18 (the number of the inner cutters 20 is correspondingly the same) provided in the shaver head 24, and only one of them is shown in FIG. 1. The number of outer cutters 18 (and inner cutters 20) is not limited to three. It goes without saying that the present invention is applicable to shavers having one, two or four or more outer and inner cutters.

Inner cutter drive shafts 28 (only one shown) are provided so as to protrude from a cutter receiving base 26 attached to the upper part of the main body case 16. The inner cutter drive shafts 28 transmit the rotational force of a motor 12 to the inner cutters 20 (only one shown) and are provided in a number equal to the number of the inner cutters 20. When the shaver head 24 is attached to the main body case 16, the tip ends of the inner cutter drive shafts 28 engage with inner cutter bases 22 to which the inner cutters 20 are fastened. The inner cutters 20 are thus rotated as a unit with the inner cutter drive shafts 28 by the motor 12. This basic structure is the same as that of the conventional shaver.

The characteristic structures of the shaver according to the present invention will be described in detail with reference to FIGS. 1 through 5.

First, the shaver head 24 will be described.

The shaver head 24 is substantially comprised of a cutter frame 30, outer cutters 18, an outer cutter holder 32 in which the outer cutters 18 are mounted, inner cutters 20, inner cutter bases 22 to which the inner cutters 20 are attached, and a retaining plate 34 which holds the inner cutters 20 so that the inner cutters 20 can be rotated.

One characteristic feature of the present invention is that each of the outer cutters 18 is comprised of two independent elements: an inside outer-cutter member 74 and a substantially cylindrical outside outer-cutter member 76. The outside outer-cutter member 76 concentrically surrounds the inside outer-cutter member 74 and is provided in the cutter frame 30 so that the end surfaces of the outside outer-cutter member 76 and inside outer-cutter member 74 protrude from an outer cutter hole 42 formed in the cutter frame 30.

Another characteristic feature of the present invention is that so as correspond to the structure of the outer cutters 18, each of the inner cutters 20 is comprised of two independent elements: an inside inner-cutter member 82 and an outside inner-cutter member 84. The inside inner-cutter member 82 is rotated while making sliding contact with the inside outer-cutter member 74, and the outside inner-cutter member 84 is rotated while making sliding contact with the outside outer-cutter member 76.

Further detailed structures will be described.

Structure of the Outer Cutters

Figure 2:
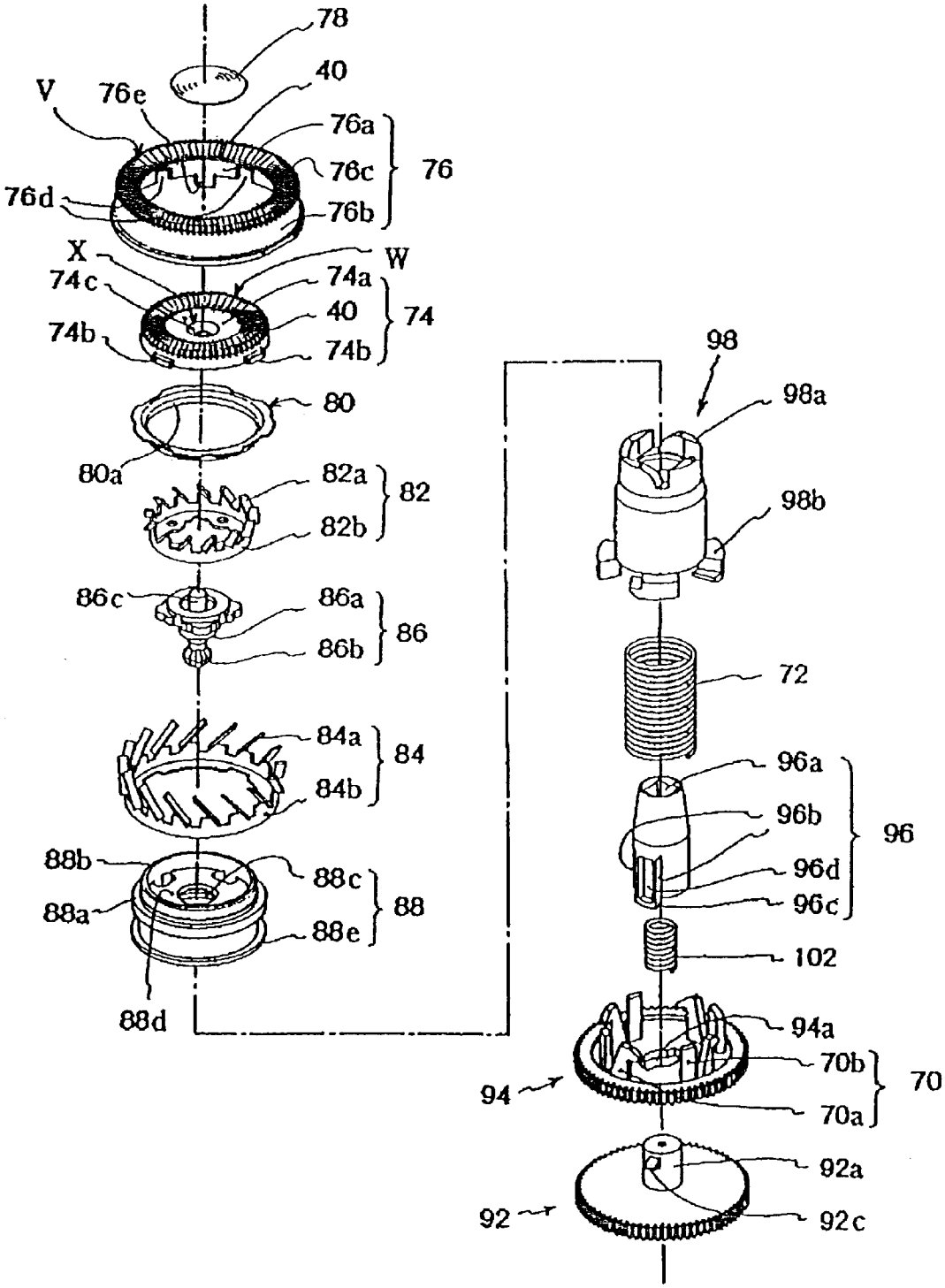
FIG. 2 is an exploded perspective view of the outer cutters and inner cutters, and the structures of the driving systems for these cutters.

In each one of the three outside outer-cutter members 76, as shown in FIG. 2, the respective end surfaces (upper end surfaces in FIG. 2) located at one end (upper end) of an inner cylindrical body 76*a* and at one end (upper end) of an outer cylindrical body 76*b* (the cylindrical body being concentrically or coaxially positioned) are connected by an annular plate body 76*c*. An outer hair entry region V is formed in this plate body 76*c*. As one example, the hair entry openings 40 of the hair entry region V are slit-form openings that extend in substantially a radial direction. As indicated in the prior art shaver, the hair entry openings 40 is not limited to slits, and other appropriate shapes can be employed as the hair entry openings.

A plurality of cut-outs 76*d* which extend along the direction of the axis of the inner cylindrical body 76*a* and which reach the other end surface (lower end surface in FIG. 2) of the inner cylindrical body 76*a* are formed in the inner cylindrical body 76*a*. Similarly, a plurality of positioning extensions 76*e* are formed in the other end surface of the inner cylindrical body 76*a* in positions where the cut-outs 76*d* are not formed.

A fastening ring 80 is fastened between the positioning extensions 76*e* on the lower portion of the inner cylindrical body 76*a* so as to close off the cut-outs 76*d* and connect the inner cutter 20 to the outer cutter 18 in a state that allows some play. Thus, the fastening ring 80 forms a part of the outside outer-cutter member 76. The inner-circumference of this fastening ring 80 has a cylindrical edge 80*a*. When this cylindrical edge 80*a* is engaged with the tip end of an outside inner-cutter member base (described later), the outside inner-cutter member 84 can be rotated so that the axis of the outside inner-cutter member 84 coincides with the axis of the outside outer-cutter member 76. In the above engagement relationship, the tip end of tip end of the outside inner-cutter member base is inserted into the cylindrical edge 80*a* of the fastening ring 80. However, it is possible to reverse the structure, so the cylindrical edge 80*a* of the fastening ring 80 is inserted into the tip end of the outside inner-cutter member.

The positioning extensions 76*e* function as a positioning means for this fastening ring 80.

Each inside outer-cutter member 74 is in an inverted saucer shape (in other words, it has a cap shape). The inside outer-cutter member 74 is lower in height than the outside outer-cutter member 76. The external diameter of the inside outer-cutter member 74 is slightly smaller than the internal diameter of the inner cylindrical body 76*a* of the outside outer-cutter member 76. An annular inner hair entry region W is formed in the outer edge area of the upper surface 74*a* of the inside outer-cutter member 74. The hair entry openings 40 of the hair entry region W are slit-form openings, for instance, that extend in substantially the radial direction of the inside outer-cutter member 74.

Connecting projections 74*b* are formed so as to protrude from the outer circumferential surface of the inside outer-cutter member 74. The connecting projections 74*b* are equal in number to the cut-outs 76*d* of the inner cylindrical body 76*a* of the outer cutter 18, and they are formed at positions that correspond to the cut-outs 76*d*. The width of the connecting projections 74*b* in the circumferential direction is slightly smaller than the width of the cut-outs 76*d* in the circumferential direction. Thus, when the outside outer-cutter member 76 and inside outer-cutter member 74 are connected by advancing the connecting projections 74*b* into the cut-outs 76*d*, the inside outer-cutter member 74 can tilt in all directions with respect to and inside the outside outer-cutter member 76, and it can also protrude and retract with respect to the outside outer-cutter member 76; however, the relative rotation of the respective cutter members is restricted.

Furthermore, a positioning engaging portion 74*c*, formed as a cylindrical engaging recess in the shown embodiment, is formed in the center of the upper surface 74*a* of the inside outer-cutter member 74. The positioning engaging portion 74*c* engages with a positioning engagement portion formed on the inside inner-cutter member base (described later). Thus, the axis of the inside inner-cutter member 82 attached to the inside inner-cutter member base is coincide with the axis of the inside outer-cutter member 74.

The reference numeral 78 in FIG. 2 is a cover that is mounted in the center of the upper surface 74*a* of the inside outer-cutter member 74. The cover 78 hides the positioning engaging portion 74*c* of the inside outer-cutter member 74.

Each inside outer-cutter member 74 is connected to the corresponding outside outer-cutter member 76 in the following manner: the inside outer-cutter member 74 is first inserted into the inner cylindrical body 76*a* of the outside outer-cutter member 76 while the respective connecting projections 74*b* are engaged with the respective cut-outs 76*d*; the fastening ring 80 is installed between the positioning extensions 76*e* of the outside outer-cutter member 76; the outer circumferential edge of the fastening ring 80 is welded to the lower end surface of the inner cylindrical body 76*a* of the outside outer-cutter member 76. The fastening ring 80 is fastened to the outside outer-cutter member 76, and the open ends of the cut-outs 76*d* are closed off by the fastening ring 80. The above connection is performed with the axis of the inner cylindrical body 76*a* being kept coincide with the axis of the fastening ring 80.

As a result, the outside outer-cutter member 76 and the inside outer-cutter member 74 are connected so that they cannot be separated and the relative rotation is prohibited.

Within the outside outer-cutter member 76, the inside outer-cutter member 74 is movable in the direction of the axis of the outside outer-cutter member 76. In other words, the inside outer-cutter member 74 can be moved between a position where the inner hair entry region W protrudes relative to the outer hair entry region V and a position where the inner hair entry region W is located lower than the outer hair entry region V.

Each outer cutter 18 that is formed by the integrally connected outside outer-cutter member 76 and inside outer-cutter member 74 is provided in the outer cutter holder 32 made of a synthetic resin, so that the outer cutter 18 is not rotated relative to the outer cutter holder 32, so that the outer cutter 18 is movable within a specified range in the direction of its own axis, and so that the outer cutter 18 can tilt within a specified range relative to its own axis.

The outer cutters 18 are mounted inside the cutter frame 30 together with the outer cutter holder 32 so that the end surfaces (or upper surfaces) of the outer cutters 18 protrude from outer cutter holes 42 of the cutter frame 30. The outside outer-cutter members 76 of the outer cutters 18 are movable in the direction of the axes of the outer cutter holes 42 relative to the cutter frame 30, and they are tiltable in all directions about the axes of the outer cutter holes 42. The inside outer-cutter members 74 are movable in the direction of the axes of the outside outer-cutter members 76, and they are tiltable in all directions about the axes of the outside outer-cutter members 76.

Structure of the Inner Cutters

In the present invention, the inner cutters 20 and inner cutter bases 22 are also respectively comprised of two independent elements so as to correspond to the structures of the outer cutters 18. This is another feature of the present invention.

More specifically, each of the inner cutters 20 (only one inner cutter 20 is shown in FIGS. 1 and 2) is comprised of two independent elements: an inside inner-cutter member 82 and an outside inner-cutter member 84. So as to correspond to the inner-cutter members 82 and 84, each of the inner cutter bases 22 (only one inner cutter base 22 is shown in FIGS. 1 and 2) to which the inner cutters 20 are mounted is also comprised of two independent elements: an inside inner-cutter member base 86 and an outside inner-cutter member base 88.

The detailed structures of these elements will be described.

Each inside inner-cutter member 82 is provided with a plurality cutting elements 82*a*. These cutting elements 82*a* are disposed in upright positions at equal intervals in a single row along the circumference of the inside inner-cutter member 82 so as to positionally correspond to the inner hair entry region W of the outer cutter. The cutting elements 82*a* are formed on a ring-shaped supporting portion 82*b* of the inside inner-cutter member 82.

Likewise, each outside inner-cutter member 84 is provided with a plurality of cutting elements 84*a*. These cutting elements 84*a* are disposed in upright positions at equal intervals in a single row along the circumference of the outside inner-cutter member 84 so as to positionally correspond to the outer hair entry region V of the outer cutter. The cutting elements 84*a* are formed on a ring-shaped supporting portion 84*b* of outside inner-cutter member 84.

Structure of the Inner-Cutter Member Bases

Each of the inside inner-cutter member bases 86 is in a columnar shape and is made of a synthetic resin material, and the inside inner-cutter member 82 is attached to one end (the upper end in FIG. 2) of this inside inner-cutter member base 86. A positioning engagement portion 86*c* (formed for example as an engaging projection) is formed in the upper end surface of the inside inner-cutter member base 86 so as to pass through the inside inner-cutter member 82. The positioning engagement portion 86*c* engages with the positioning engaging portion 74*c* (formed as an engaging recess) of the inside outer-cutter member 74 and thus causes the axis of rotation of the inside inner-cutter member base 86 to coincide with the axis of the inside outer-cutter member 74.

Furthermore, anti-slipping parts 86*a* are protruded in the radial direction from the outer circumferential surface of an intermediate portion of the inside inner-cutter member base 86. In addition, an end-bump 86*b* is formed on the other end (the lower end in FIG. 2) of the inside inner-cutter member base 86. The cross-section of the maximum diameter portion of the end-bump 86*b* in the direction perpendicular to the axis of the inside inner-cutter member base 86 has a non-circular shape (in the shown embodiment, a polygonal shape such as a square shape, etc). Furthermore, the lower end surface of the end-bump 86*b* is formed as a protruding curved surface (e.g., a hemispherical surface). The end-bump 86*b* is set in a connecting recess formed in the inner-cutter member drive shaft (described later). Thus, the end-bump 86*b* connects the inside inner-cutter member base 86 and the inner-cutter member drive shaft so that these two components are rotatable as an integral unit, and so that the inside inner-cutter member base 86 is tiltable in all directions with respect to the axis of the inner-cutter member drive shaft. In other words, the end-bump 86*b* and the connecting recess form a swivel coupling. Conversely, the end-bump can be formed on the inner-cutter member drive shaft, and the connecting recess is formed on the inside inner-cutter member base.

Each of the outside inner-cutter member bases 88 is a cylindrical body and is made of a synthetic resin material. The outside inner-cutter member 84 is fitted over the first end (the upper end in FIG. 2) of this outside inner-cutter member bases 88. The outside inner-cutter member 84 thus mounted is attached to a fastening flange 88*a* which is formed on the outer circumferential surface of the first end (upper end) of the outside inner-cutter member base 88. The tip end 88*b* of the first end of the outside inner-cutter member base 88 set in the ring-shaped outside inner-cutter member 84 is inserted and engaged in the cylindrical edge 80*a* of the fastening ring 80 of the outside outer-cutter member 76. As a result, the outside inner-cutter member base 88 is supported in a rotatable fashion so that the axis of the outside inner-cutter member base 88, i.e., the axis of the outside inner-cutter member 84, is kept coincides with the axis of the outside outer-cutter member 76. Thus, no wobbling of the axis of rotation of the outside inner-cutter member 84 occurs inside the outside outer-cutter member 76.

Furthermore, a disk-form member 88*d* is formed inside the first end of the outside inner-cutter member base 88. The disk-form member 88*d* has a base insertion hole 88*c* at its center so as to allow the inside inner-cutter member base 86 to be inserted therein. The radius of this base insertion hole 88*c* is slightly smaller than the distance from the axis of the inside inner-cutter member base 86 to the tip ends of the anti-slipping parts 86*a*. Furthermore, an anti-slipping flange 88*e* is formed on the outer circumferential surface of the second end (lower end in FIG. 2) of the outside inner-cutter member 84. The external diameter of the fastening flange 88*a* is substantially the same as the external diameter of the anti-slipping flange 88*e*. Practically, the radii of the flanges 88*a* and 88*e* are slightly greater than the distance from the center of the attachment ring 34*a* to the tip ends of the anchoring portions 48.

Structure of the Cutter Retaining Plate

As in the prior art shaver, the inner cutters 20 are provided and held in the attachment rings 34*a* formed in the cutter retaining plate 34.

In other words, as in the prior art shaver, the cutter retaining plate 34 is made of a synthetic resin material and is comprised of the attachment rings 34*a*. The attachment rings 34*a* are equal in number to the inner cutters 20, and they are located so as to positionally correspond to the inner cutters 20 and are connected by the supporting frame 34*b*. Also as in the prior art shaver, the anchoring portions 48 protrude from the inner circumferential surface of each attachment ring 34*a*, and the attachment screw 50 is provided in the center of the cutter retaining plate 34.

Figure 4:
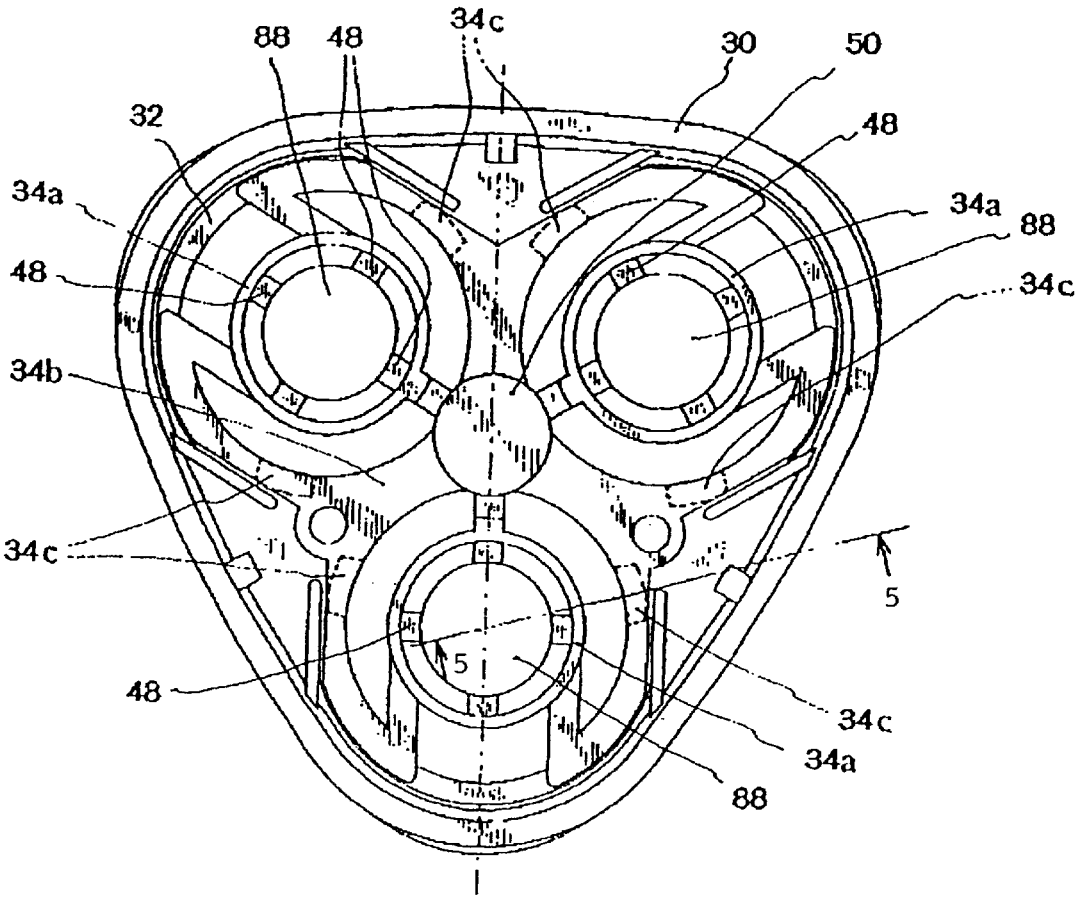
FIG. 4 is a bottom view of the shaver head.

The structure of the supporting frame 34*b* of the cutter retaining plate 34 will be described in a concrete manner with reference to FIGS. 4 and 1. FIG. 4 shows the shape of the cutter retaining plate 34 in a plan view, and FIG. I shows the internal structure of the shaver head 24.

The supporting frame 34*b* includes three U-shaped members which are integrally connected to each other in a Y configuration with the open ends of the respective members facing outward, and the attachment screw 50 is provided at the center of the supporting frame 34*b*. The attachment screw 50 comprised of a head part 50*a*, a columnar part 50*b* which extends from the head part 50*a*, and a small-diameter screw part 50*c* which protrudes from the tip end of the columnar part 50*b*. The columnar part 50*b* passes through the central portion of the supporting frame 34*b*, and a C-ring 51, etc. is fitted over the root portion of the screw part 50*c*. Thus, the attachment screw 50 can make a relative rotation with respect to the supporting frame 34*b* but is unable to slip out of the supporting frame 34*b*. Furthermore, as seen from FIG. 1, a primary spring (coil spring) 53 is fitted over the columnar part 50*b* of the attachment screw 50. The supporting frame 34*b* is constantly driven toward the C-ring 51 with reference to the head part 50*a* of the attachment screw 50 by this primary spring 53. As a result, the supporting frame 34*b* tightly contact the C-ring 51 when no external force is applied to the supporting frame 34*b*. However, when the supporting fame 34*b* is pressed uniformly toward the head part 50*a* of the attachment screw 50 against the driving force of the primary spring 53, the supporting frame 34*b* is moved toward the head part 50*a* of the attachment screw 50 along the columnar part 50*b* of the attachment screw 50. When, to the contrary, when the supporting fame 34*b* is pressed toward the head part 50*a* by force that is not uniform, then the supporting frame 34*b* tilts with respect to the axis of the attachment screw 50.

The attachment rings 34*a* are positioned inside the respective U-shaped members of the supporting frame 34*b*. The attachment rings 34*a* and U-shaped members are connected, for instance, at three points as shown in FIG. 4.

Figure 5:
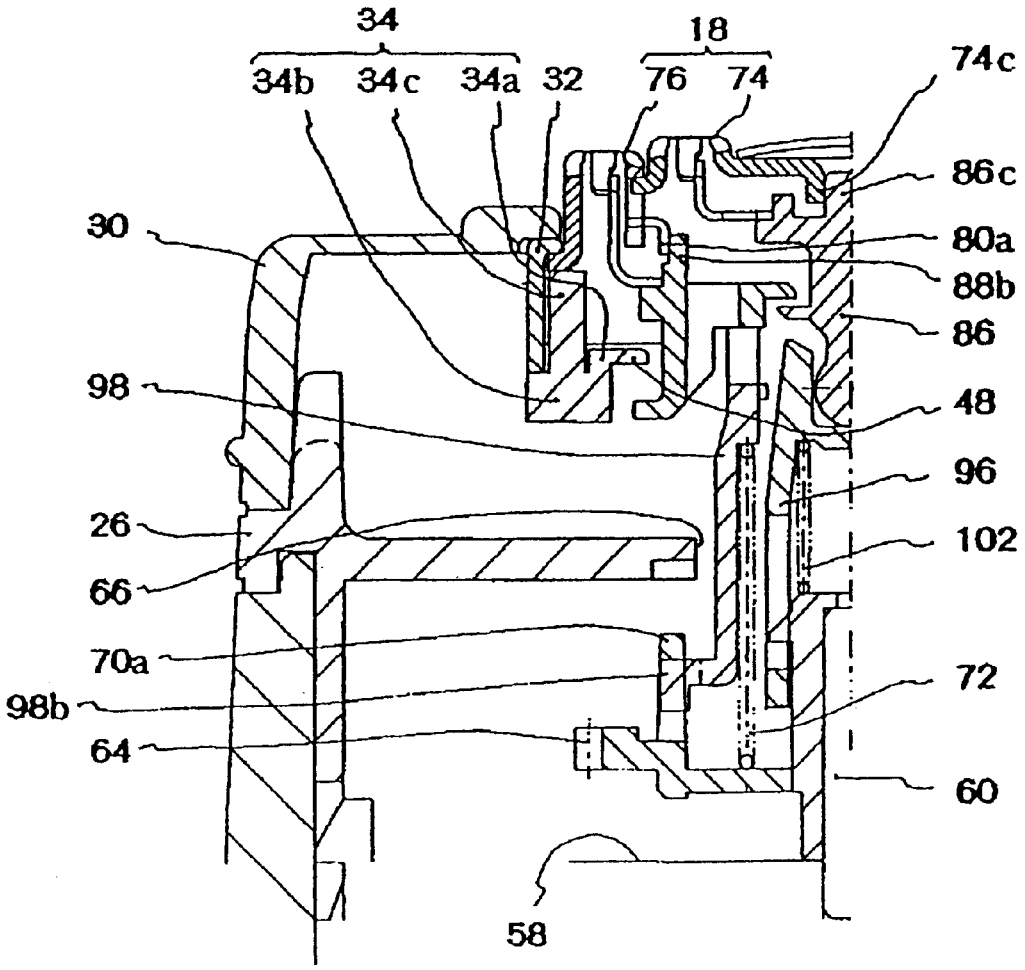
FIG. 5 is a sectional view taken along the line 5—5 in FIG. 4 showing the shaver head mounted on the main body case.

In addition, as seen from FIGS. 4 and 5, pairs of supporting portions 34*c* are formed on the end surfaces of the respective U-shaped members at substantially symmetrical positions on both sides of the attachment rings 34*a*. These supporting portions 34*c* advance into the interiors of the outer cutter holder 32 when the cutter retaining plate 34 is attached to the cutter frame 30, and the tip ends of these supporting portions 34*c* contact the undersurfaces of the outside outer-cutter members 76. There are no particular restrictions on the number or positions of the supporting portions 34*c*.

Structure of the Inner Cutters Held by the Cutter Retaining Plate

The structure for holding the inner cutters 20 by the cutter retaining plate 34 will be described below.

First, each outside inner-cutter member base 88 which has the outside inner-cutter member 84 attached to its first end (the upper end in FIGS. 1 and 2) is inserted into one of the attachment rings 34*a* of the cutter retaining plate 34 from the second end (lower end in FIGS. 1 and 2) so that this second protrudes. In this case, the anti-slipping flange 88*e* formed on the outer circumferential surface of the second end (lower end) of the outside inner-cutter member base 88 interferes with the anchoring portions 48 protruding from the inner circumferential surface of the attachment ring 34*a*. Utilizing the elastic bend of the anchoring portions 48 (which are made of a synthetic resin), the anti-slipping flange 88*e* is brought into the interior of the attachment ring 34*a*.

As a result, the anti-slipping flange 88*e* and the fastening flange 88*a* of the outside inner-cutter member base 88 are positioned so that the anchoring portions 48 are held between the flanges 88*a* and 88*e*. Consequently, as in the inner cutters 20 and inner cutter bases 22 of the prior art shaver structure, when the outside inner-cutter member base 88 is moved along the axis of the corresponding attachment ring 34*a*, the anchoring portions 48 engage with the anti-slipping flange 88*e* or fastening flange 88*a*. The outside inner-cutter member base 88 is thus held in the cutter retaining plate 34 so as to be tiltable and rotatable inside the attachment ring 34*a* and is prevented from slipping out of the attachment ring 34*a*.

Second, the inside inner-cutter member 82 attached to the inside inner-cutter member base 86 is pushed into the base insertion hole 88*c* of the outside inner-cutter member base 88 from the end-bump 86*b* side of the inside inner-cutter member base 86 by way of elastically bending the anti-slipping parts 86*a* of the inside inner-cutter member base 86. As a result, the inside inner-cutter member 82 is connected to and held by the outside inner-cutter member base 88 in a rotatable fashion and is prevented from dropping out of the base insertion hole 88*c* of the outside inner-cutter member base 88. In this connected state, the inside inner-cutter member 82 is surrounded by the outside inner-cutter member 84 in substantially a concentric configuration.

As a result of the above structure, the inside inner-cutter member 82 is held, together with the corresponding outside inner-cutter member 84, in the corresponding attachment ring 34*a* of the cutter retaining plate 34 so that the inner-cutter members 82 and 84 are rotatable independently of each other. In addition, the axes of the inner-cutter members 82 and 84 are tiltable independently of each other in all directions with respect to the axis of the corresponding attachment ring 34*a*. Also, these inner-cutter members 82 and 84 are free to move independently of each other in the direction of the axis of the corresponding attachment ring 34*a*.

Attachment of the Outer Cutters and Inner Cutters to the Cutter Frame

The structure for attaching the outer cutters 18 and inner cutters 20 to the cutter frame 30 is substantially the same as that in the prior art rotary shaver.

More specifically, the outer cutter holder 32, to which the outer cutters 18 formed by the inside outer-cutter member 74 and outside outer-cutter member 76 connected into an integral unit is attached, is first attached to the cutter frame 30.

Then, using the attachment screw 50 over which the primary spring 53 is fitted, the cutter retaining plate 34 that holds the inner cutters 20 formed by the inside inner-cutter members 82 and outside inner-cutter members 84 integrally connected is attached to the cutter frame 30.

As a result, the outer cutter holder 32 is pressed by the supporting frame 34*b* of the cutter retaining plate 34 as shown in FIG. 1. Also, the outer cutters 18 (more specifically, the outside outer-cutter members 76) held in the outer cutter holder 32 are pressed by the supporting portions 34*c* that protrude from the U-shaped members of the supporting frame 34*b*. The outer cutters 18 and inner cutters 20 are thus attached to the cutter frame 30 so that the outer and inner cutters are prevented from slipping out.

When the cutter retaining plate 34 is attached to the cutter frame 30, the solid cylindrical positioning engagement portions 86*c* of the inside inner-cutter member bases 86 advance into the interiors of the hollow cylindrical positioning engaging portions 74*c* of the outside outer-cutter members 74 and are thus engaged. As a result, the axes of the inside outer-cutter members 74 and inside inner-cutter members 82 are kept coincide. Moreover, the cylindrical tip ends 88*b* of the outside inner-cutter member bases 88 advance into the cylindrical edges 80*a* of the fastening rings 80 of the outside outer-cutter members 76. As a result, the axes of the outside outer-cutter members 76 and outside inner-cutter members 84 kept coincide.

In the shown embodiment, the positioning engagement portion 86*c* are formed as solid cylindrical elements, while the positioning engaging portions 74*c* are formed as hollow cylindrical elements. However, the positioning engagement portions 86*c* can be conversely formed as hollow cylindrical elements, and the positioning engaging portions 74*c* are formed as solid cylindrical elements. The engagement of these elements is accomplished by bringing the positioning engaging portions 74*c* into the positioning engagement portions 86*c*.

When the attachment screw 50 is turned in the reverse direction, the inner cutters 20, as a unit with the cutter retaining plate 34, can be removed from the cutter frame 30. Also, the outer cutters 18, as a unit with the outer cutter holder 32, are removed from the cutter frame 30.

Structure of the Main Body Case

The structure of the main body case 16 that includes the inner cutter drive shafts 28 will be described.

The main body case 16 is made of a synthetic resin material and has a cylindrical body. The main body case 16 is open at the top and closed at the bottom. A motor 12, battery (not shown), control circuit, and other components are installed inside the main body case 16.

A gear shaft receiving plate 58 is installed inside the main body case 16 so that it is near the rim of the opening of the main body case 16. The motor 12 is fastened to the gear shaft receiving plate 58 so that the output shaft 12*a* of the motor 12 protrudes from the shaft receiving plate 58. Main supporting shafts 60 and second supporting shafts 90 are installed adjacent to the output shaft 12*a* of the motor 12 and parallel to the output shaft 12*a*. These main supporting shafts 60 and 90 are positionally separated from each other.

The characteristic feature of the main body case 16 of the present embodiment is that in conformity with the structures of the above-described outer and inner cutters 18 and 20, the inner cutter driving gears 64 are respectively comprised of independent inside inner-cutter member driving gears 92 and outside inner-cutter member driving gears 94.

The inner cutter drive shafts 28 are also respectively comprised of independent inside inner-cutter member drive shafts 96 and outside inner-cutter member drive shafts 98.

The output shaft 12*a* of the motor 12 is provided with a motor gear 62. The inside inner-cutter member driving gears 92, which rotate the inside inner-cutter members 82, and the outside inner-cutter member driving gears 94, which are carried on the upper surfaces of the inside inner-cutter member driving gears 92 and rotate the outside inner-cutter members 84, are attached to the main supporting shafts 60 so that these gears 92 and 94 are rotated independently to each other.

Reverse-rotation gears 100 are rotatably coupled to the second supporting shafts 90. The gears 62, 92, 94 and 100 are made of synthetic resins.

Structure of the Driving Gears The structures of the inside inner-cutter member driving gears 92 and outside inner-cutter member driving gears 94 will be described in greater detail. The engagement relationships of the respective gears 92 and 94 with the motor gear 62 and reverse-rotation gears 100 will be also described.

On the upper surface of each inside inner-cutter member driving gear 92, a columnar body 92*a* is formed so as to be coaxial with the axis of the inside inner-cutter member driving gear 92. Inside the columnar body 92*a*, a first supporting shaft hole 92*b* is formed so as to open at the undersurface of the inside inner-cutter member driving gear 92 and to be coaxial with the axis of the inside inner-cutter member driving gear 92. In addition, inside shaft anchoring projections 92*c* are formed so as to protrude from the outer circumferential surface of the end (upper end in FIGS. 1 and 2) of the columnar body 92*a*. These anchoring projections 92*c* are formed near the end of the columnar body 92*a* that faces the inner cutter 20.

In the outside inner-cutter member driving gears 94, a connecting hole 94*a* is formed in the center of and coaxial with the columnar body 92*a* of the inside inner-cutter member driving gears 92. Into this connecting hole 94*a*, the columnar body 92*a* of the inside inner-cutter member driving gear 92 is inserted. In addition, outside shaft anchoring projections 70 are formed on the upper surface of the outside inner-cutter member driving gear 94 so that the outside shaft anchoring projections 70 surround the connecting hole 94*a*. As seen from FIG. 2, each of these outside shaft anchoring projections 70 comprises a hook 70*a* and a guide 70*b*. The hook 70*a* and the guide 70*b* protrude and are formed so as to be apart from other on concentric circles centered on the axis of the outside inner-cutter member driving gear 94. In the embodiment shown in FIG. 2, four pairs of hooks 70*a* and guides 70*b* are formed. The diameter of the outer edge of the outside inner-cutter member driving gear 94 on which tooth are formed is set so as to be larger than the diameter of the outer edge of the inside inner-cutter member driving gear 92 on which tooth are formed.

Figure 3A:
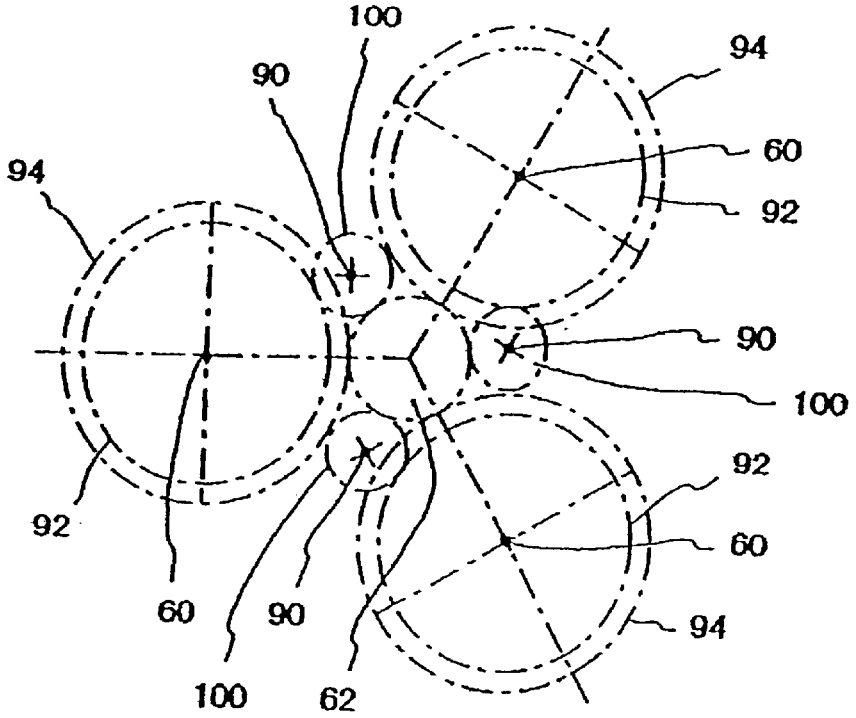
FIG. 3A is a plan view of the engagement relationships of the inner-cutter member driving gears, outer-cutter member driving gears, motor gear and reverse-rotation gears for rotating the inside and outside inner-cutter members in the different directions.

As seen from FIG. 3A, the motor gear 62 engages with the respective outside inner-cutter member driving gears 94 and the respective reverse-rotation gears 100. The respective inside inner-cutter member driving gears 92 engage with the reverse-rotation gears 100.

With this gear arrangement, the rotation of the motor gear 62 is transmitted directly to the respective outside inner-cutter member driving gears 94 and is also transmitted via the respective reverse-rotation gears 100 to the respective inside inner-cutter member driving gears 92. Since one reverse-rotation gear 100 is interposed between each inside inner-cutter member driving gear 92 and the motor gear 62, the direction of rotation of the inside inner-cutter member driving gears 92 is opposite to the direction of rotation of the outside inner-cutter member driving gears 94.

The rpm (revolution per minute) values of the inside inner-cutter member driving gears 92 and outside inner-cutter member driving gears 94, i.e., the respective rotating values of the inside inner-cutter members 82 and outside inner-cutter members 84 can be adjusted by appropriately setting the respective numbers of teeth of the inside inner-cutter member driving gears 92, outside inner-cutter member driving gears 94 and reverse-rotation gears 100. The circumferential speed of the respective inside inner-cutter members 82 and outside inner-cutter members 84 can also be adjusted. Accordingly, the rpm values and circumferential speeds of the respective inner-cutter members 82 and 84 are independently set at optimal values that are determined by tests and experiences, so that the shaving conditions can be improved.

Structure of the Inner-Cutter Member Drive Shafts

At the opening of the main body case 16, a cutter receiving base 26 is provided so as to close the opening. Drive shaft holes 66 are opened in the cutter receiving base 26 so as to coaxially correspond to the main supporting shafts 60 (i.e., opened directly above the main supporting shafts 60). The inner cutter drive shafts 28 are installed so that their tip ends protrude from the drive shaft holes 66.

The inner cutter drive shafts 28 are for transmitting the rotational force of the motor 12 to the inner cutters 20. Each of these inner cutter drive shafts 28 is comprised of an inside inner-cutter member drive shaft 96 and an outside inner-cutter member drive shaft 98. The inside inner-cutter member drive shaft 96 has a tubular shape and rotates the corresponding inside inner-cutter member 82. The outside inner-cutter member drive shaft 98 has also a tubular shape so as to surround the inside inner-cutter member drive shaft 96 and rotates the corresponding outside inner-cutter member 84. These drive shafts 96 and 98 are made of a synthetic resin material.

The structure for connecting the respective drive shafts 96 and 98 with the respective driving gears 92 and 94 and the respective inner-cutter member bases 86 and 88 will be described below in greater detail.

Each of the inside inner-cutter member drive shafts 96 is formed in a tubular shape. The end which faces the inner cutter 20 (the upper end in FIGS. 1 and 2) is closed off, and a connecting recess 96*a* which is to be connected to the end-bump 86*b* of the corresponding inside inner-cutter member base 86 is formed in this closed end. Two pairs of slits 96*b* which extend downward in the direction of the axis of the inside inner-cutter member drive shaft 96 are formed in the outer circumferential surface of the inside inner-cutter member drive shaft 96. The regions between the respective slits 96*b* form elastically bendable tongue parts 96*c*; and engaging slots 96*d* which extend in the direction of the axis are respectively formed in the two tongue parts 96*c*.

In the shown embodiment, each of the connecting recesses 96*a* is formed as a recess so that the end-bump 86*b* of the corresponding inside inner-cutter member base 86 can be inserted therein. The cross-sectional shape of the inner circumferential surface of each of these connecting recesses 96*a*, when cut in a plane perpendicular to the axis of the inside inner-cutter member drive shaft 96, is a non-circular shape (for example, a square shape). Thus, the cross-sectional shape of the inner circumferential surface of each connecting recess 96*a* conforms to the cross-sectional shape of the end-bump 86*b* in the direction perpendicular to the axis thereof.

As a result, the inside inner-cutter member base 86 with its end-bump 86*b* inserted in the connecting recess 96*a* of the inside inner-cutter member drive shaft 96 can rotate together with the inside inner-cutter member drive shaft 96 when the inside inner-cutter member drive shaft 96 is rotated. The rotational force of the inside inner-cutter member drive shaft 96 is thus transmitted to the corresponding inside inner-cutter member 82. The diameter of the portion of the inside inner-cutter member base 86 located above the end-bump 86*b* is effectively reduced to a smaller diameter than that of the end-bump 86*b*, and the shape of the undersurface of the end-bump 86*b* that contacts the inside bottom surface of the connecting recess 96*a* is formed as a protruding curve. Accordingly, the inside inner-cutter member base 86 can smoothly tilt in all directions within a specified angular range relative to the axis of the inside inner-cutter member drive shaft 96 with its end-bump 86*b* as a fulcrum. In this case, any interference of the rim portion of the connecting recess 96*a* with the outer circumferential surface of the inside inner-cutter member base 86 is prevented.

Structures of the Inner-Cutter Member Driving Gears and Inner-Cutter Member Drive Shafts The inside inner-cutter member drive shaft 96 is provided therein with an inside inner-cutter member spring (called "inner spring") 102, which is a coil spring, but a plate spring, etc. may also be used instead. The inside inner-cutter member drive shaft 96 with the inner spring 102 is fitted over the columnar body 92*a* of the inside inner-cutter member driving gear 92 that protrudes from the upper surface of the outside inner-cutter member driving gear 94. This mounting of the inside inner-cutter member drive shaft 96 is accomplished from above the columnar body 92*a* of the inside inner-cutter member driving gear 92).

When the inside inner-cutter member drive shaft 96 is mounted over the columnar body 92*a* of the inside inner-cutter member driving gear 92, the lower ends of the tongue parts 96*c* of the inside inner-cutter member drive shaft 96 temporarily run up against the inside shaft anchoring projections 92*c* formed on the outer circumferential surface of the tip end of the columnar body 92*a* of the inside inner-cutter member driving gear 92. However, the tongue parts 96*c* elastically bend back so that the inside shaft anchoring projections 92*c* of the inside inner-cutter member driving gear 92 enter the engaging slots 96*d* of the inside inner-cutter member drive shaft 96.

Once the inside shaft anchoring projections 92*c* have entered the engaging slots 96*d*, the inside inner-cutter member drive shaft 96 is constantly driven in the direction that causes the inside inner-cutter member drive shaft 96 to move away from the columnar body 92*a* of the inside inner-cutter member driving gear 92 by the driving force received from the compressed inner spring 102. However, since the inside shaft anchoring projections 92*c* are engaged with the lower inner surfaces of the engaging slots 96*d*, the inside inner-cutter member drive shaft 96 is prevented from slipping out of the columnar body 92*a* of the inside inner-cutter member driving gear 92.

As a result, the inside inner-cutter member drive shaft 96 is connected with the inside inner-cutter member driving gear 92 so that relative rotation of these two elements is prevented. The inside inner-cutter member drive shaft 96 is not only rotated as a unit with the inside inner-cutter member driving gear 92 but also moved in the direction of its won axis within the range determined by the length of the engaging slots 96*d*.

Accordingly, the inside inner-cutter member base 86 connected to the inside inner-cutter member drive shaft 96, and the inside inner-cutter member 82 mounted on this inside inner-cutter member base 86, are rotated as a unit with the inside inner-cutter member driving gear 92.

On the other hand, each of the outside inner-cutter member drive shafts 98 is in a tubular shape. A plurality (four in the shown embodiment) of upper end engaging projections 98*a* that engage with the lower end of the outside inner-cutter member base 88 are formed side by side in the circumferential direction on the upper end surface of the outside inner-cutter member drive shaft 98. Also, lower end engaging projections 98*b* that engage with the outside shaft anchoring projections 70 of the outside inner-cutter member driving gears 94 are formed on the outer circumferential surface of the lower end of the outside inner-cutter member drive shaft 98. The lower end engaging projections 98*b* are provided in the same number as the outside shaft anchoring projections 70.

Each of these outside inner-cutter member drive shafts 98, having the outer spring 72 therein, is fitted over the corresponding inside inner-cutter member drive shaft 96 so that the outer spring 72 covers the drive shaft 96. In this case, the lower end engaging projections 98*b* formed on the lower end of the outside inner-cutter member drive shaft 98 advance into the areas between the hooks 70*a* and guides 70*b*, which comprise the outside shaft anchoring projections 70, and engage with the hooks 70*a*.

When each outside inner-cutter member drive shaft 98 is fitted over the corresponding inside inner-cutter member drive shaft 96, the lower end of the outer spring 72 contacts the upper surface of the corresponding outside inner-cutter member driving gear 94, and the upper end of the outer spring 72 contacts a step part formed in the inner circumferential surface of the outside inner-cutter member drive shaft 98. The outer spring 72 is thus compressed.

As a result, the outside inner-cutter member drive shaft 98 receives a driving force from the outer spring 72 that constantly drives the outside inner-cutter member drive shaft 98 in a direction away from the outside inner-cutter member driving gear 94. However, if the outside inner-cutter member drive shaft 98 is moved upward along the guides 70*b* of the outside inner-cutter member driving gear 94, this upward movement is restricted when the lower end engaging projections 98*b* of the outside inner-cutter member drive shaft 98 come to engage with the hooks 70*a* of the outside inner-cutter member driving gear 94. Thus, the outside inner-cutter member drive shaft 98 is prevented from slipping out of the inside inner-cutter member drive shaft 96.

As a result, the outside inner-cutter member drive shaft 98 is connected to the outside inner-cutter member driving gear 94 so that relative rotation of these two elements is prevented. The outside inner-cutter member drive shaft 98 is rotated as a unit with the outside inner-cutter member driving gear 94.

Accordingly, the outside inner-cutter member base 88 connected to the outside inner-cutter member drive shaft 98, and the outside inner-cutter member 84 mounted on the outside inner-cutter member base 88, are rotated as a unit with the outside inner-cutter member driving gear 94.

Connecting Structure of the Shaver Head and Main Body Case

With the above-described structures of the shaver head 24 and the main body case 16, when the shaver head 24 is fitted on the main body case 16, the end-bumps 86*b* of the inside inner-cutter member bases 86 are engaged with the connecting recesses 96*a* of the inside inner-cutter member drive shafts 96. Furthermore, the lower ends of the outside inner-cutter member bases 88 are engaged with the upper end engaging projections 98*a* of the outside inner-cutter member drive shafts 98. Moreover, the inside inner-cutter member drive shafts 96 are pushed toward the inside of the cutter receiving base 26 by the inside inner-cutter member bases 86 against the driving force of the inner springs 102. Also, the outside inner-cutter member drive shafts 98 are pushed toward the inside of the cutter receiving base 26 by the inside inner-cutter member bases 86 against the driving force of the outer springs 72.

The driving force of the inner springs 102 is transmitted from the inside inner-cutter member drive shafts 96 to the inside inner-cutter members 82 via the inside inner-cutter member bases 86. The inside inner-cutter members 82 are, as a result, pressed toward the inside outer-cutter members 74 and are thus caused to make a close contact with the inside surfaces of the hair entry regions W of the inside outer-cutter members 74.

On the other hand, the driving force of the outer springs 72 is transmitted from the outside inner-cutter member drive shafts 98 to the outside inner-cutter members 84 via the outside inner-cutter member bases 88. The outside inner-cutter members 84 are, as a result, pressed toward the outside outer-cutter members 76 and are thus caused to make a close contact with the inside surfaces of the hair entry regions V of the outside outer-cutter members 76.

Thus, the respective outer-cutter members 74 and 76 are pressed by the respective inner-cutter members 82 and 84, so that the outer-cutter members 74 and 76 are in a state of maximum protrusion from the cutter frame 30.

As described above, the outer circumference of each outside outer-cutter member 76 is pressed against the upper end of the outer cutter holder 32 by the supporting portion 34*c* formed on the supporting frame 34*b* of the cutter retaining plate 34 as shown in FIG. 5. As a result, when the outside outer-cutter members 76 come into contact with the skin and as a result is pushed inside the cutter frame 30, these outside outer-cutter members 76 are moved against the driving force of the outer springs 72 and the driving force of the primary spring 53 that is fitted on the attachment screw 50. On the other hand, the inside outer-cutter members 74 is moved only against the driving force of the inner springs 102.

When hairs are to be shaved using the electric shaver as described above, the main body case 16 is held in hand of a user, and the outer cutters 18 protruding from the surface of the cutter frame 30 are pressed against the skin.

When the outer cutters 18 are not in contact with the skin, the axes of the outside outer-cutter members 76 (and of the outside inner-cutter members 84) and the axes of the inside outer-cutter members 74 (and of the inside inner-cutter members 82) are aligned on the axes of the main supporting shafts 60 along with the axes of the outside inner-cutter member drive shafts 98 and the axes of the inside inner-cutter member drive shafts 96.

Then, when the outer cutters 18 are pressed against the skin in order to shave hairs, and a certain minimum force is applied to the outer cutters 18 from the skin, the outside outer-cutter members 76 are pushed and moved toward the inside of the cutter frame 30 against the driving forces of the outer springs 72 and primary spring 53. The outside outer-cutter members 76 are also tilted in all directions with respect to the axes of the outer cutter holes 42 in conformity with the shape of the skin.

Furthermore, independently of the movements of the outside outer-cutter members 76 relative to the cutter frame 30, the inside outer-cutter members 74 are pushed and moved toward the interiors of the outside outer-cutter members 76 against the driving force of the inner springs 102. The inside outer-cutter members 74 are also tilted in all directions with respect to the axes of the outside outer-cutter members 76.

When the pushing force from the skin decreases, the inside outer-cutter members 74 and outside outer-cutter members 76 return to their original positions by the driving forces of the inner springs 102, outer springs 72 and primary spring 53.

In other words, since the inside inner-cutter member drive shafts 96 are mounted and fitted over the columnar bodies 92*a* of the inside inner-cutter member driving gears 92, when hairs are cut, the axes of the inside inner-cutter member drive shafts 96 do not tilt with respect to the axes of the main supporting shafts 60. However, the axes of the outside outer-cutter members 76 (and of the corresponding outside inner-cutter members 84), axes of the inside outer-cutter members 74 (and of the corresponding inside inner-cutter members 82) and axes of the outside inner-cutter member drive shafts 98 appropriately tilted with respect to the axes of the main supporting shafts 60 in accordance with the direction of the external force which the outer cutters 18 receive from the skin.

Accordingly, the shape of the contacting surfaces of the outer cutters 18 can be varied in accordance with the shape of the skin. More specifically, the positional relationship of the inner hair entry regions W and outer hair entry regions V formed on the contact surfaces of the outer cutters 18 with the skin can be changed. As a result, if the shape of the skin changes in various ways, the respective inner hair entry regions W and outer hair entry regions V can both be maintained in a snug contact with the skin. Thus, a great improvement in shaving efficiency can be obtained.

In the above embodiment, the inside inner-cutter members 82 and outside inner-cutter members 84 are independent. Also, the driving mechanism for these cutters, i.e., the driving gears 92 and 94 and drive shafts 96 and 98, are also independent so as to be used exclusively with the respective cutter members. Accordingly, by way of applying the rotational force of the motor to the inside inner-cutter member driving gears 92 via the reverse-rotation gears 100, the inside inner-cutter members 82 and outside inner-cutter members 84 are rotated in opposite directions. Thus, the user can be given a shaving feeling that differs from the shaving feeling obtained by the inside inner-cutter members 82 and outside inner-cutter members 84 rotating in the same direction. In other words, since the respective inner-cutter members 82 and 84 are rotated in opposite directions, hairs are efficiently cut even in cases where the hairs grow different directions.

Figure 3B:
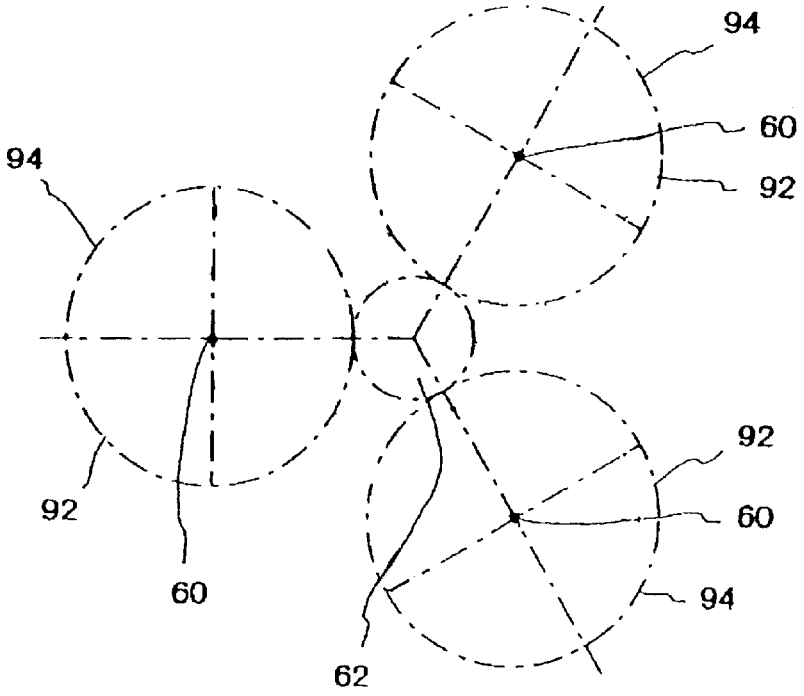
FIG. 3B is a plan view of the engagement relationships of the inner-cutter member driving gears, outer-cutter member driving gears, motor gear and reverse-rotation gears for rotating the inside and outside inner-cutter members in the same direction.

As shown in FIG. 3B, when the reverse-rotation gears 100 are not employed and the diameters of the respective driving gears 92 and 94 which are rotated by the motor gear 62 are set to be the same, then the inside and outside inner-cutter members 82 and 84 are rotated in the same direction. In this case, the motor gear 62 is directly meshed with the inside inner-cutter member driving gears 92.

When the outer cutters 18 are not in contact with the skin, the inside outer-cutter members 74 and the outside outer-cutter members 76 may protrude from the surface of the cutter frame 30 for the same amount. However, it is also possible to use a structure in which the inside outer-cutter members 74 protrude further than the outside outer-cutter members 76. In this structure in which the inside outer-cutter members 74 protrude more than the outside outer-cutter member 76, the contact with the skin is facilitated not only for the corner areas on the outer circumferences of the contact surfaces of the outside outer-cutter members 76 but also for the comer areas on the outer circumferences of the contact surfaces of the inside outer-cutter members 74. Accordingly, hairs easily enter through the slits 40 extending to the respective corner areas, and the shaving effect is enhanced.

It is advisable to design so that the driving force received by the inside outer-cutter members 74 from the inside inner-cutter members 82 is stronger than the driving force received by the outside outer-cutter members 76 from the outside inner-cutter members 84 and cutter retaining plate 34. The reason for this is as follows: when the outer cutters 18 are pressed against the skin, the inside outer-cutter members 74 and outside outer-cutter members 76 are independently moved toward the interior of the cutter frame 30 as a result of the external force from the skin; however, since the driving force received by the inside outer-cutter members 74 is stronger than the driving force received by the outside outer-cutter members 76, the outside outer-cutter members 76 are moved further into the interior of the cutter frame 30, resulting in that the above-described "structure in which the inside outer-cutter members 74 protrude further than the outside outer-cutter members 76" is obtained, and it is possible to obtain such an effect. For the structure in which the driving force received by the inside outer-cutter members 74 from the inside inner-cutter members 82 is stronger than the driving force received by the outside outer-cutter members 76 from the outside inner-cutter members 84 and cutter retaining plate 34, the strength of the driving force of the inner springs 102 is set to be greater than the strength obtained by combining the driving force of the primary spring 53 and the driving force of the outer springs 72.

Moreover, the above-described "structure in which the inside outer-cutter members 74 protrude further than the outside outer-cutter members 76" and the above-described "structure in which the driving force received by the inside outer-cutter members 74 from the inside inner-cutter members 82 is stronger than the driving force received by the outside outer-cutter members 76 from the outside inner-cutter members 84 and cutter retaining plate 34" can be combined. With this combination, the inside outer-cutter members 74 are kept so as to protrude further than the outside outer-cutter members 76 even if the shaver is pressed somewhat strongly against the skin. Accordingly, the time period for hairs entering from the corner areas of both outer-cutter members 74 and 76 can be longer, and the shaving effect can be greatly enhanced. Thus, shaving can be done more effectively.

As seen from the above, according to the electric shaver of the present invention, even if the shape of the skin contacted by the outer cutters should vary, the outside outer-cutter members and inside outer-cutter members that make up the outer cutters are moved independently. Thus, the respective contact surfaces of the outer-cutter members both make a good surface contact with the skin more easily, and the shaving are improved.

Furthermore, in the present invention, the inside inner-cutter members and the outside inner-cutter members are independent element, and the driving mechanisms of these cutter members are also independent and exclusively used for the respective cutter members. Accordingly, the inside inner-cutter members and the outside inner-cutter members are rotated in opposite directions by applying a rotational force to the inner-cutter member driving gears via reverse-rotation gears. Accordingly, hairs growing in different directions are efficiently shaved.

What is claimed is:

1. A rotary electric shaver characterized in that said shaver is comprised of:

an inside outer-cutter member;

a cylindrical outside outer-cutter member which concentrically surrounds and is separate from said inside outer-cutter member and is mounted in a cutter frame so that end surfaces of said outside outer-cutter member and inside outer-cutter member protrude from an outer cutter hole formed in said cutter frame;

an inside inner-cutter member which makes a sliding contact with said inside outer-cutter member; and an outside inner-cutter member separate from said inside inner-cutter member which makes a sliding contact with said outside outer-cutter member, and wherein said outside outer-cutter member is provided in said cutter frame so that said outside outer-cutter member is tiltable with respect to an axis of said outer cutter hole and is movable along said axis of said outer cutter hole;

said inside outer-cutter member is tiltably connected to said outside outer-cutter member so that said inside outer-cutter member is tiltable with respect to an axis of said outside outer-cutter member and is movable along said axis of said outside outer-cutter member;

said inside inner-cutter member is engaged with said inside outer-cutter member so that said inside inner-cutter member is rotatable in a state in which axes of said inside and outside inner-cutter members are kept coincide with each other; and said outside inner-cutter member is engaged with said outside outer-cutter member so that said outside inner-cutter member is rotatable in a state in which axes of said inside and outside outer-cutter members are kept coincide with each other.

2. The rotary electric shaver according to claim 1 wherein:

said inside inner-cutter member is mounted on an inside inner-cutter member base, and an end surface of said inside inner-cutter member base facing said inside outer-cutter member is engaged in an interlocking manner with said inside outer-cutter member.

3. The rotary electric shaver according to claim 1, wherein said inside inner-cutter member and said outside inner-cutter member are rotated in the same direction.

4. The rotary electric shaver according to claim 1, wherein said inside outer-cutter member is protruded further than said outside outer-cutter member.

5. The rotary electric shaver characterized in that said shaver is comprised of:

an inside outer-cutter member;

a cylindrical outside outer-cutter member which concentrically surrounds said inside outer-cutter member and is mounted in a cutter frame so that end surfaces of said outside outer-cutter member and inside outer-cutter member protrude from an outer cutter hole formed in said cutter frame;

an inside inner-cutter member which makes a sliding contact with said inside outer-cutter member; and an outside inner-cutter member which makes a sliding contact with said outside outer-cutter member, and wherein said outside outer-cutter member is provided in said cutter frame so that said outside outer-cutter member is tiltable with respect to an axis of said outer cutter hole and is movable along said axis of said outer cutter hole;

said inside outer-cutter member is connected to said outside outer-cutter member so that said inside outer-cutter member is tiltable with respect to an axis of said outside outer-cutter member and is movable along said axis of said outside outer-cutter member;

said inside inner-cutter member is engaged with said inside outer-cutter member so that said inside inner-cutter member is rotatable in a state in which axes of respective said cutter members are kept coincide with each other;

said outside inner-cutter member is engaged with said outside outer-cutter member so that said outside inner-cutter member is rotatable in a state in which axes of respective cutters are kept coincide with each other;

said outside inner-cutter member is mounted on a cylindrical outside inner-cutter member base, and an end of said cylindrical outside inner-cutter member base facing said outside outer-cutter member and a circumferential portion of said cylindrical outside outer-cutter member are engaged by inserting one into another.

6. The rotary electric shaver according to claim 2 or 5, further comprising:

an inside inner-cutter member drive shaft which is connected to said inside inner-cutter member base and rotates said inside inner-cutter member base, an outside inner-cutter member drive shaft which is a cylindrical body concentrically surrounding said inside inner-cutter member drive shaft, said outside inner-cutter member drive shaft being connected to said outside inner-cutter member base and rotating said outside inner-cutter member base in a rotational manner, an inside inner-cutter member spring which constantly drives said inside inner-cutter member drive shaft toward said inside outer-cutter member so that said inside inner-cutter member makes a close contact with said inside outer-cutter member, and an outside inner-cutter member spring which constantly drives said outside inner-cutter member drive shaft toward said outside outer-cutter member, so that said outside inner-cutter member makes a close contact with said outside outer-cutter member.

7. The rotary electric shaver according to claim 6 wherein:

an end-bump in which a cross-sectional shape of a maximum-diameter portion thereof in a direction perpendicular to an axis of said inside inner-cutter member drive shaft is non-circular is formed on either one of said inside inner-cutter member base or said inside inner-cutter member drive shaft, a connecting recess for accommodating therein said end-bump, a shape of an inner circumferential surface of said connecting recess along an axial direction of said inside inner-cutter member drive shaft is formed as a non-circular shape that corresponds to said cross-sectional shape of said end-bump is formed on the other of said inside inner-cutter member base or said inside inner-cutter member drive shaft, and said inside inner-cutter member base and inside inner-cutter member drive shaft are connected by a free axial coupling structure by way of said end-bump and connecting recess.

8. A rotary electric shaver characterized in that said shaver is comprised of:

an inside outer-cutter member;

a cylindrical outside outer-cutter member which concentrically surrounds said inside outer-cutter member and is mounted in a cutter frame so that end surfaces of said outside outer-cutter member and inside outer-cutter member protrude from an outer cutter hole formed in said cutter frame;

an inside inner-cutter member which makes a sliding contact with said inside outer-cutter member; and an outside inner-cutter member which makes a sliding contact with said outside outer-cutter member, and wherein said outside outer-cutter member is provided in said cutter frame so that said outside outer-cutter member is tiltable with respect to an axis of said outer cutter hole and is movable along said axis of said outer cutter hole;

said inside outer-cutter member is connected to said outside outer-cutter member so that said inside outer-cutter member is tiltable with respect to an axis of said outside outer-cutter member and is movable along said axis of said outside outer-cutter member;

said inside inner-cutter member is engaged with said inside outer-cutter member so that said inside inner-cutter member is rotatable in a state in which axes of respective said cutter members are kept coincide with each other;

said outside inner-cutter member is engaged with said outside outer-cutter member so that said outside inner-cutter member is rotatable in a state in which axes of respective cutters are kept coincide with each other; and said inside inner-cutter member and said outside inner-cutter member are rotated in opposite directions.

9. The rotary electric shaver according to claim 8 or 3, wherein number of revolutions of said inside inner-cutter member and said outside inner-cutter member are the same.

10. The rotary electric shaver according to claim 8 or 3, wherein number of revolutions of said inside inner-cutter member and said outside inner-cutter member are different.

11. The rotary electric shaver according to claim 8 or 3, wherein circumferential speed of said inside inner-cutter member and circumferential speed of said outside inner-cutter member are the same.

12. The rotary electric shaver according to claim 8 or 3, wherein circumferential speed of said inside inner-cutter member and circumferential speed of said outside inner-cutter member are different.

* * * * *